US011708681B2

(12) United States Patent
Currier et al.

(10) Patent No.: US 11,708,681 B2
(45) Date of Patent: Jul. 25, 2023

(54) SYSTEM AND METHOD FOR BUCKET AGITATION DURING AUTOMATED PAYLOAD TIP-OFF

(71) Applicant: Caterpillar Inc., Peoria, IL (US)

(72) Inventors: Shaun D. Currier, Naperville, IL (US); Eric W. Cler, Oswego, IL (US)

(73) Assignee: Caterpillar Inc., Peoria, IL (US)

( * ) Notice: Subject to any disclaimer, the term of this patent is extended or adjusted under 35 U.S.C. 154(b) by 113 days.

(21) Appl. No.: 17/229,489

(22) Filed: Apr. 13, 2021

(65) Prior Publication Data

US 2022/0325497 A1 Oct. 13, 2022

(51) Int. Cl.

| | |
|---|---|
| ***E02F 3/42*** | (2006.01) |
| ***E02F 3/43*** | (2006.01) |
| ***E02F 9/22*** | (2006.01) |

(52) U.S. Cl.

CPC ..... *E02F 3/42* (2013.01); *E02F 3/434* (2013.01); *E02F 9/2271* (2013.01)

(58) Field of Classification Search

CPC ... E02F 3/42; E02F 3/434; E02F 9/221; E02F 9/2271

See application file for complete search history.

(56) References Cited

U.S. PATENT DOCUMENTS

| | | | | |
|---|---|---|---|---|
| 6,725,105 | B2 | 4/2004 | Francis et al. | |
| 6,757,992 | B1 | 7/2004 | Berger et al. | |
| 7,117,952 | B2 | 10/2006 | Bares et al. | |
| 8,515,627 | B2 | 8/2013 | Marathe et al. | |
| 9,529,347 | B2 * | 12/2016 | Roach | E02F 9/264 |
| 10,246,855 | B2 * | 4/2019 | Greer | E02F 3/3414 |
| 10,508,410 | B2 * | 12/2019 | Hoshaku | E02F 3/437 |
| 10,813,265 | B2 * | 10/2020 | Stanhope | A01B 69/007 |
| 2015/0134209 | A1 | 5/2015 | Lee | |
| 2018/0100290 | A1 * | 4/2018 | Greer | E02F 3/3414 |
| 2018/0220577 | A1 * | 8/2018 | Posselius | A01B 63/1112 |
| 2020/0100419 | A1 * | 4/2020 | Stanhope | A01B 19/10 |
| 2020/0263384 | A1 | 8/2020 | Currier | |

FOREIGN PATENT DOCUMENTS

| | | |
|---|---|---|
| CN | 105696638 B | 9/2018 |

* cited by examiner

*Primary Examiner* — Tyler J Lee

(57) ABSTRACT

A wheel loader machine includes a bucket configured to hold a predetermined load of a granular or powder material, a hydraulic system having an electro-hydraulic actuator to move the bucket over tilt angles and to shake the bucket, a hydraulic sensor configured to detect hydraulic pressure, an interface configured to receive input parameters and to output status information of the bucket, and a controller. The input parameters including a target weight of the granular or powder material. The status information including weight of the granular or powder material in the bucket determined using the detected hydraulic pressure. The controller configured to control the hydraulic system to tilt the bucket to a predetermined tilt angle and to shake the bucket in accordance with an agitation pattern until the weight of the granular or powder in the bucket is at or below the target weight of the granular or powder material.

20 Claims, 14 Drawing Sheets

SYSTEM AND METHOD FOR BUCKET AGITATION DURING AUTOMATED PAYLOAD TIP-OFF

TECHNICAL FIELD

The present disclosure generally relates to a construction vehicle having a bucket and automated payload tip-off system and, more particularly, to a wheel loader machine and method for agitating a loader bucket during automated payload tip-off.

BACKGROUND

At worksites, such as excavation, surface mines, construction, and agricultural sites, worksite loader-type machines such as wheel loaders, track-type loaders, backhoe loaders, and the like are relied upon to load loose payload material into haul vehicles such as over the road haul trucks. It is essential that the haul truck is sufficiently loaded to maximum capacity avoiding underloading or overloading situations which can be undesirable from a productivity and efficiency standpoint.

Typically, loader-type machines have a payload control system which can accurately measure the payload in the bucket. Once activated, the payload control system can sum successive bucket payloads to determine an estimated amount of payload already deposited into the haul truck. During the final pass, the operator adjusts the final amount of payload in the bucket to be dumped at a pile or dumps only a partial amount from the bucket directly into the haul truck. This process is referred to as tip-off or tipping-off. The former situation is known as pile tip-off where in-vehicle sensors determine the load in the bucket and the operator tips-off excess payload onto the pile. The latter situation is known as truck tip-off where the operator racks the bucket and partially empties the bucket into the haul truck until the target payload capacity is reached.

One strategy exists in co-owned U.S. Patent Application 2020/0263384, in which automated payload target tip-off for loading a haul vehicle is described. The tip-off includes a slow dump sequence in which a plurality of dump then rack actuations to induce and then prevent material spill are performed until the remaining payload target is met. Types of materials that a bucket may carry can range from rocks, stones, crushed stone, dirt, to fine grained materials and fine powders. The slow dump sequence in the tip-off process may not operate robustly for the different materials whose properties of stacking, angle of repose, cohesion, and density differ greatly. Further, it may be difficult to decide when the material will spill, how it will spill out a certain volume, and how stable it will be (how spill-resistant the material is in the bucket). This is especially true for materials that do not flow smoothly. For example, fine grained or fine powdery materials tend to be sticky, making them difficult to spill out to obtain the payload target.

One approach to loading materials has been to apply vibration to the bucket before spilling in order to shake and loosen the material. For example, U.S. Pat. No. 7,117,952 to Bares, et al. issued Oct. 10, 2006 discloses an automated attachment vibration system that includes an automatic vibration mechanism for causing the attachment member to vibrate automatically in response to an activation signal. The automatic vibration of the attachment member may be used for shaking out an attached bucket, or for digging the bucket into a material, or for packing down a material with the bucket. This approach offers the ability to achieve a desired load that is within an improved tolerance. For example, the approach to handling fine grained material for a load of 10 tons may be achieved within a tolerance of about 5/10 to 6/10 ton. However, applying vibration can lead to inconsistent results depending on the type of materials and therefor tends to be unreliable. In addition, applying vibration to shake and loosen the material before spilling may require shaking the bucket a number of times, which is time consuming.

The disclosed system and method of agitating a loader bucket during automated payload tip-off for loading a haul vehicle is directed to overcoming one or more of the problems set forth above.

SUMMARY

In one aspect, a method is disclosed of controlling motion of a bucket having at least one electronically controlled actuator controlled by a control signal from a computer controller upon receiving sensor signals from at least one hydraulic sensor associated with the bucket. The method can comprise receiving a target weight of a granular or powder material; receiving an agitation pattern of a signal waveform shape with one or more frequencies and one or more amplitudes over a time period; detecting, via the sensor signals, that a weight of the granular or powder material in the bucket is within a final bucket load of the target weight; measuring, via the sensor signals, the weight of the granular or powder material and updating a remaining amount to reach the target weight; spilling from the bucket a portion of the granular or powder material in accordance with the agitation pattern; while performing the spilling from the bucket, shaking the bucket in accordance with the agitation pattern to agitate the granular or powder material, and updating the remaining amount; and performing the spilling and the shaking in accordance with the agitation pattern until the remaining amount is equal to or less than the target weight.

In another aspect, a construction vehicle can include an electro-hydraulic system, a bucket operated by the electro-hydraulic system and an automated tip-off system including an agitation system. The automated tip-off system can comprise an input-output device configured to receive input of control parameters and to output bucket status information; and a controller configured to receive inputs of a respective plurality of hydraulic pressures in the electro-hydraulic system, produce a control signal for controlling the electro-hydraulic system to operate the bucket, and to automatically control the agitation system to generate a shaking motion of the bucket to spill granular or powder material according to an agitation pattern when the controller produces a control signal for a tip motion of the bucket.

And in another aspect, a wheel loader machine is disclosed. The wheel loader machine can comprise a bucket configured to hold a predetermined load of a granular or powder material; a hydraulic system having at least one electro-hydraulic actuator to move the bucket over a range of tilt and rack angles and to shake the bucket; a hydraulic sensor configured to detect at least one hydraulic pressure in the hydraulic system; an input-output interface configured to receive input parameters and to output status information of the bucket, the input parameters including a target weight of the granular or powder material, the status information including a weight of the granular or powder material in the bucket determined based on the at least one hydraulic pressure detected by the hydraulic sensor; and an automated tip-off system including an agitation system, the automated tip-off system that can include a controller configured to control the hydraulic system to tilt the bucket to a predetermined tilt angle and to shake the bucket in accordance with an agitation pattern until the weight of the granular or powder material in the bucket is at or below the target weight of the granular or powder material.

DETAILED DESCRIPTION

Aspects of the disclosure will now be described in detail with reference to the drawings, wherein like reference numbers refer to like elements throughout, unless specified otherwise.

Figure 1:
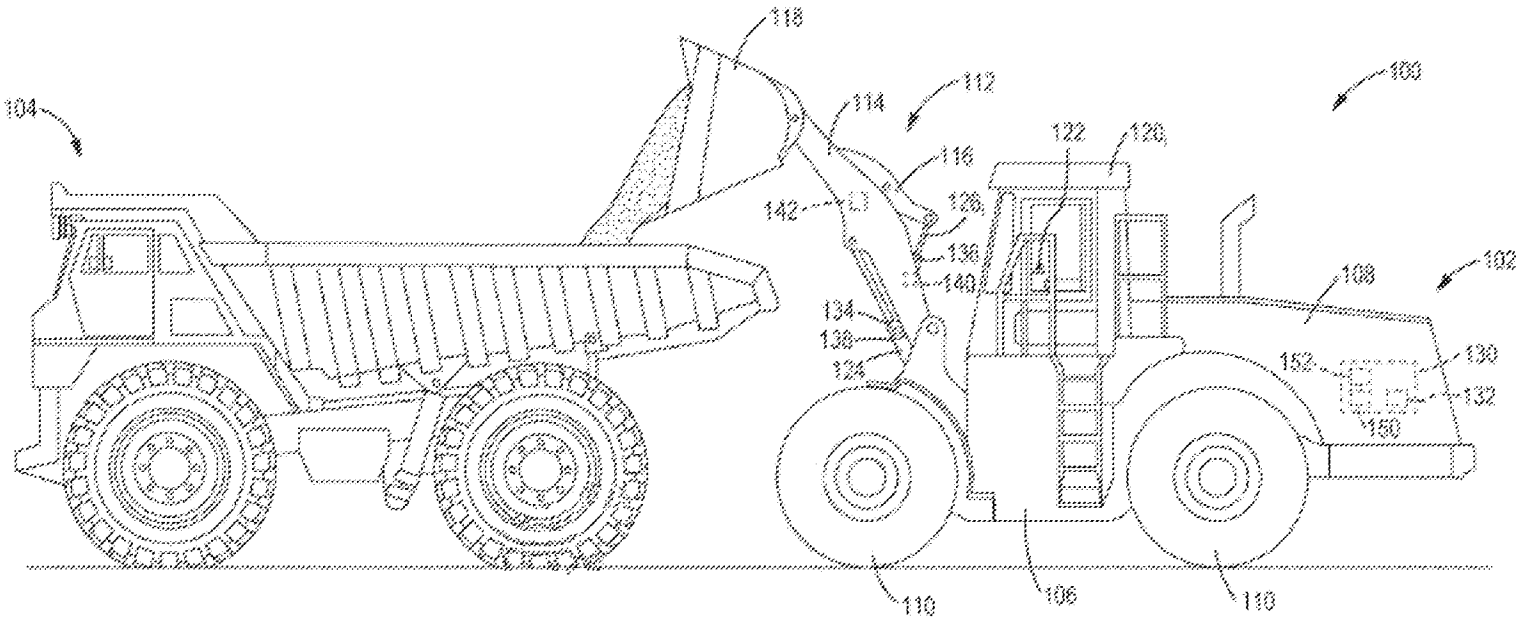
FIG. 1 is a diagrammatic side view of a wheel loader machine for a worksite in accordance with one or more embodiments of the disclosed subject matter.

Embodiments of the disclosed subject matter are directed to a construction vehicle having a bucket and an automated tip-off system with an agitation system to achieve a target load in the bucket. The construction vehicle may include a loader-type machine, such as a wheel loader, track-type loader, backhoe loader, and the like. For simplicity of description of the automated tip-off system, a wheel loader machine will be used herein as a non-limiting example of a loader-type machine. FIG. 1 is a diagrammatic side view of a wheel loader machine 102 for a worksite 100 in accordance with one or more embodiments of the disclosed subject matter. Referring to FIG. 1, an exemplary wheel loader machine 102 in a worksite 100 is illustrated. The wheel loader machine 102 is generally a machine having a movable bucket 118 for digging.

The wheel loader machine 102 includes a frame or chassis 106. A power source (not shown) is provided on the frame 106 of the wheel loader machine 102. The power source may be any power source known in the art such as an internal combustion engine, an electric motor, a power storage device such as batteries, and a hybrid engine. The power source is configured to provide power to the wheel loader machine 102 for operational and mobility requirements. The wheel loader machine 102 includes a set of ground engaging members 110, such as wheels. Alternatively, the ground engaging members 110 may include tracks. The ground engaging members 110 are configured to provide mobility to the wheel loader machine 102 on ground. The wheel loader machine 102 also includes a powertrain 108, also referred to as a drivetrain, coupled to the power source and the ground engaging members 110. The powertrain 108 may include a transmission assembly having one or more gears, shafts, differentials, torque convertors, hydraulic pumps or motors, and so on. The powertrain 108 may be configured to transmit motive power from the power source to the ground engaging members 110 as well as to supply generated power to other parts of the wheel loader machine 102.

The wheel loader machine 102 includes a linkage assembly 112 pivotally coupled to the frame 106. The linkage assembly 112 includes at least one linkage member 114 pivotally coupled to the frame 106 and a support arm 116. A bucket 118 is pivotally coupled to the linkage member 114. The linkage assembly 112 also includes a lift cylinder 124 for causing movement of the linkage member 114 and the coupled bucket 118 with respect to the frame 106 of the wheel loader machine 102.

The linkage assembly 112 is configured to perform tasks such as earth moving, excavation, digging, dumping and so on. Further, the linkage assembly 112 may be controlled electrically, mechanically, hydraulically, pneumatically or by a combination thereof. The wheel loader machine 102 also includes an operator cabin 120 provided on the frame 106 of the wheel loader machine 102. The operator cabin 120 includes an operator interface, such as a touch display device 122.

During operation of the wheel loader machine 102, the linkage member 114 and the bucket 118 may be moved to different positions in order to perform dump operations. A hydraulic system or a pneumatic system (not shown) may be used to effectuate a movement of the linkage member 114, the support arm 116, and/or the bucket 118 of the linkage assembly 112. For example, a lift cylinder 124 and a tilt cylinder 126 may effectuate and control the movement of the bucket 118. The cylinders 124, 126 may embody any one of a hydraulic cylinder and a pneumatic cylinder. Based on the movement of the linkage member 114 and the bucket 118, the wheel loader machine 102 may perform different operations such as moving, digging, dumping, excavating, and the like.

The dump operation of the payload may require tipping of a desired amount of payload from the bucket 118 into the haul truck 104, known as truck tip-off, or may require tipping off excess material from a payload onto a pile, known as pile tip-off. Tipping off refers to the process of spilling a partial amount of material of the payload from the bucket 118 based on operation requirements. For example, an operator of a wheeled loader with an 18 ton bucket capacity may be required to load a 45 ton capacity haul truck 104 to maximum capacity. The goal of the loader operator is to load as much tonnage into the haul truck 104 in the shortest amount of time while consuming the least amount of fuel of the loader in order to achieve peak efficiency and reduce operation costs. The operator must also load the haul truck 104 within a payload tolerance without overloading the haul truck 104. It takes a considerable amount of skill for an operator to load haul trucks within the desired payload tolerances. For example, to achieve the 45 ton capacity, the operator can dump two passes at the maximum capacity of the loader bucket 118 to achieve 36 tons. In a final pass, the operator must only dump 9 tons of material to achieve the desired payload. Depending on the skill of the operator, the final pass can take anywhere from 3 to 5 times as long as the first two passes.

To reduce the duration of the final pass and reduce the overall time to achieve a target payload in a haul truck 104, the wheel loader machine 102 includes a payload detection system (PDS) 130. The PDS 130 includes a tip-off controller 132 and at least one sensor for generating an electronic signal associated with the material weight in the bucket 118 and an electronic signal associated with the angle of the bucket 118. In one embodiment, the PDS 130 includes a lift pressure sensor 134 associated with the lift cylinder 124 and a tilt pressure sensor 136 associated with the tilt cylinder 126 to enable the detection of hydraulic fluid pressure within the respective cylinders 124, 126. The fluid pressure signals associated with the respective cylinders 124, 126 may be used, alone or in combination, to determine the weight of the material within the bucket 118. The PDS 130 may include a lift displacement sensor 138 associated with the lift cylinder 124 and a tilt displacement sensor 140 associated with the tilt cylinder 126. The displacement signals associated with the respective cylinders 124, 126 together with the fluid pressure signals can be used to determine the weight of the material within the bucket 118. The PDS 130 may also include an inertial measurement unit (IMU) 142 which includes circuitry that can generate a signal indicative of a position, velocity, motion, and orientation of the linkage assembly 112 and/or the bucket 118 which can be used to determine the weight of the material within the bucket 118. It should be appreciated that the PDS 130 may include any of a number of measurement devices and sensors in accordance with the particular requirements of the particular worksite application not specifically described herein.

The tip-off controller 132 may include, or be coupled with as part of the PDS 130, at least one processing device 150 which is configured to perform the functions of the tip-off controller 132. The processing device 150 may include a single microprocessor or multiple microprocessors that include components for receiving and monitoring the sensor signals of the PDS 130 of the wheel loader machine 102. For example, the processing device 150 is configured to receive the fluid pressure signals from the lift and tilt pressure sensors 134, 136; the displacement signal from the lift and tilt displacement sensors 138, 140; and the position, velocity, motion, and orientation signals from the IMU 142. It should be appreciated that the processing device 150 could readily be embodied in a general machine microprocessor capable of controlling numerous machine functions.

The tip-off controller 132 may further include, or be coupled with as part of the PDS 130, memory module 152 such as one or more data storage devices or another component or circuit that may be used to run computer executable instructions that are stored to the memory module 152. It should be appreciated that various computer executable instructions, applications, computer program products, or other aspects that are generally described as stored to memory can also be stored on or read from various non-transitory computer readable media such as, but not limited to, as computer chips and secondary storage devices, including hard disks, floppy disks, optical media such as CD-ROM and DVD disks, or other forms of RAM or ROM.

The processing device 150 may be configured with arithmetic units to algorithmically determine the weight of the material in the bucket 118 based on any one of the sensor signals, alone or in combination, according to predetermined mathematical relationships which are stored in the memory module 152. The memory module 152 may store payload weight history data in order to determine, for example, a summed total weight of material loaded into the haul truck 104 during a loading procedure. The processing device 150 also includes arithmetic units to algorithmically determine the angle of the bucket 118 based on any one of the sensor signals, alone or in combination, according to predetermined mathematical relationships which are stored in the memory module 152.

Figure 2:
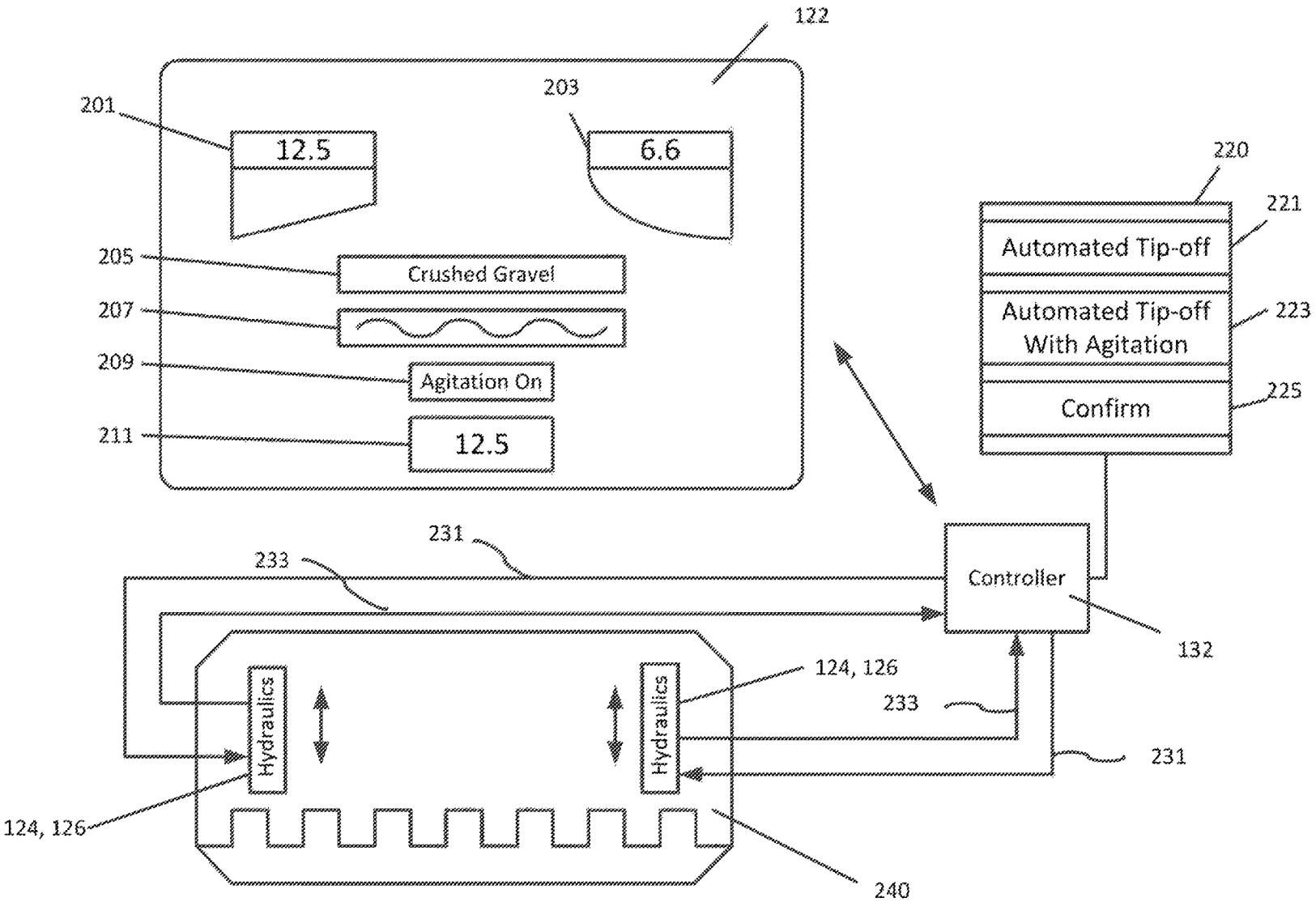
FIG. 2 is a block diagram of a control system for controlling automated payload tip-off with a bucket in accordance with one or more embodiments of the disclosed subject matter.

FIG. 2 is a block diagram of a control system for controlling an electro-hydraulic operated bucket. The control system includes an operator interface, such as a display device 122, operation buttons 220, a tip-off controller 132, and a hydraulic system 240 having at least one, and preferably, two or more electro-hydraulic actuators including tilt cylinders 124, 126. The display device 122 may display in display area 201 an estimated total remaining weight of material to be loaded into haul truck 104 and display in display area 203 a current weight of material currently in the bucket 118. The estimated total remaining weight of material varies with the current weight of material in the bucket 118. When the current weight of material is spilled from the bucket 118, the estimated total weight of remaining material is lowered by the same amount. The display device 122 may also include input functions, including an material-type input 205 for a type of material and a target (total) weight input 211 for a target (total) weight of material to be loaded into haul truck 104. The display device 122 may display in display area 207 a tip-off agitation profile, and in display area 209 an operation status.

The operation buttons 220 may include an automated tip-off button 221, an automated tip-off with agitation button 223, and a confirm button 225. The confirm button 225 is used to lock-in the weight of material currently in the bucket 118 as the amount that will be loaded into a haul truck 104.

The layout of display areas and buttons shown in FIG. 2 is only exemplary. Other configurations of those and additional display areas and buttons, as well as the possible omission of some such display areas and buttons, are not excluded.

The tip-off controller 132 may be a microcontroller having analog and/or digital inputs and outputs, as well as a Digital-Analog (D/A) converter and a Analog-Digital (A/D) converter for conversion of analog input or output signals, as needed. The inputs to the tip-off controller 132 include a pressure signal 233 of the hydraulic system 240. The hydraulic pressure may be obtained using one or more hydraulic pressure sensors 134, 136. The outputs of the tip-off controller 132 include a hydraulic system control signal 231 of a wave shape, amplitude and frequency. The hydraulic system control signal 231 controls the actuation of the electro-hydraulic actuators including lift cylinder 124 and tilt cylinder 126. The tip-off controller 132 includes a memory module 152 to store one or more control signal patterns, including one or more agitation patterns.

INDUSTRIAL APPLICABILITY

The wheel loader machine 102 may be used to load the haul truck 104. The wheel loader machine 102 may perform various operations at the worksite. In one example, the wheel loader machine 102 may perform a payload dump operation. More particularly, the wheel loader machine 102 may dump a payload into the haul truck 104. The haul truck 104 may include machines, such as, a dump truck, a mining truck, or any other machine that is capable of holding and transporting the payload from one location to another on the worksite 100. Alternatively, the wheel loader machine 102 may dump the payload in a pile, a hopper, or other payload receiver at the worksite 100.

Applying agitation during the automated tip-off process encourages various types of material to tip-off in a predictable manner. To achieve a weight of a material that is substantially within a target weight in a minimal amount of time, the tip-off controller 132 may control digging of the material and depositing of the material into a haul truck 104 by a tip and check process when the amount of the material is within one dig of achieving the target load for the haul truck 104. In the tip and check process, the tipping is performed by adjusting the tilt angle of the bucket 118, either gradually or in fixed increments. A check may be performed periodically during tipping, or when the bucket 118 is raked to prevent further spilling. As will be described later, the check in the tip and check process can include measuring the weight of the material in the bucket 118. The tip and check process may be performed automatically upon pressing one of the Automated Tip-off button 221 or the Automated Tip-off With Agitation button 223. The Automated Tip-off button 221 or the Automated Tip-off With Agitation button 223 may be required to be held-down during operation to ensure operator intention to use the automation. Releasing the hold cancels the automation. The tip and check process may be performed in two steps, a bulk spill followed by a fine tip and check of the bucket 118. In the case of the Automated Tip-off With Agitation, a finer tip and check of the bucket 118 may be performed with agitation.

The agitation may be accomplished by performing an agitation pattern having a wave shape. The agitation pattern may be accomplished by shaking the bucket 118 in accordance with a flick motion of the bucket and/or a buzz motion of the bucket during tipping of the bucket 118 under control of the tip-off controller 132 and electro-hydraulic actuators, including lift cylinder 124 and tilt cylinder 126. The bucket 118 may be shaken by a lift cylinder 124 motion, a tilt cylinder 126 motion, or a lift 124 and tilt 126 cylinder motion simultaneously or in alternating order. The agitation pattern may involve a flick motion and/or buzz motion that is performed in accordance with a wave shape that gradually changes in amplitude and/or frequency. A finer tip and check may be repeated two or three times using the same or different agitation pattern each time. The decision of when to tip, agitate, or perform a combination of both may be selected based on remaining weight to spill and expected material behavior as learned by an operator and/or the tip-off controller 132 from how much the material spilled during prior actions.

Figure 3:
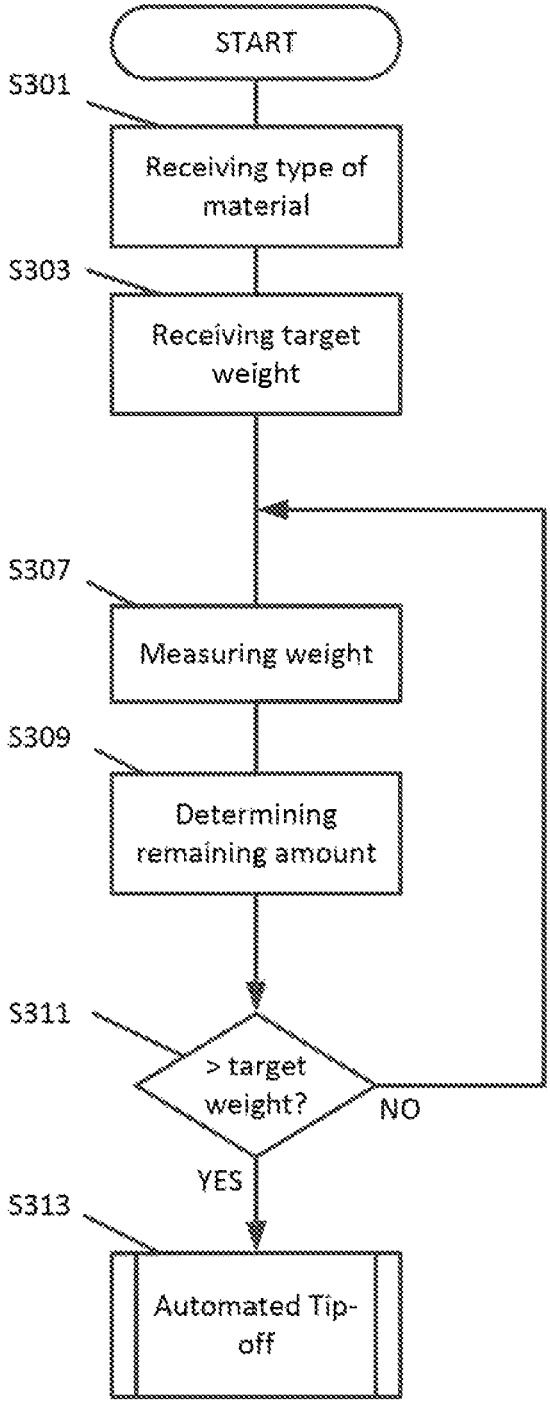
FIG. 3 is a flowchart of a method of bucket automated payload tip-off in accordance with one or more embodiments of the disclosed subject matter.

FIG. 3 is a flowchart of a method of bucket agitation. The method is performed by the tip-off controller 132 that controls activation of the lift cylinder 124 and the tilt cylinder 126 by way of a hydraulic system control signal 231 and a pressure signal 233. The display device 122 receives input and displays output information of the controller. The operator may input, via the display device 122, the type of material to be dug and loaded into the haul truck. In S301, the tip-off controller 132 may receive, at material-type input 205, the type of material to be loaded. In one or more embodiments, the type of material is an optional input. The operator may input the target weight of the material to be loaded into the haul truck 104. In S303, the tip-off controller 132 receives, at target weight input 211, the target weight of the material.

The electro-hydraulic operated bucket 118 may perform some initial bulk digging. The electro-hydraulic operated bucket 118 may dig an arbitrary amount of the material into the bucket 118. In S307, the wheel loader machine 102 measures the weight of the material that is in the bucket 118. Weight of material in the bucket 118 may be measured based on the pressure in the hydraulic system 240, in the form of pressure signal 233. The current weight of the material in the bucket 118 may be displayed in a display area 203. In S309, the tip-off controller 132 may determine a remaining weight of the material needed to be loaded into the haul truck 104 to reach the target weight of the material.

In S311, the tip-off controller 132 determines whether the weight of material in the bucket 118 is above the amount of material needed to reach the target weight. When the weight of the material exceeds the amount to reach the target weight (YES in S311), an automatic payload tip-off process may be performed.

In S313, the automatic payload tip-off process may be started by pressing and holding a button and/or lever (as noted above, the holding is to ensure continued operator intention to use the automation); the Automated Tip-off button 221 or the Automated Tip-off With Agitation button 223 are examples of buttons that may be pressed and held. In an embodiment, a button may be pressed to arm the automated tip-off and then a lever is held to indicate continued consent. Releasing the lever cancels the automation.

Figure 4:
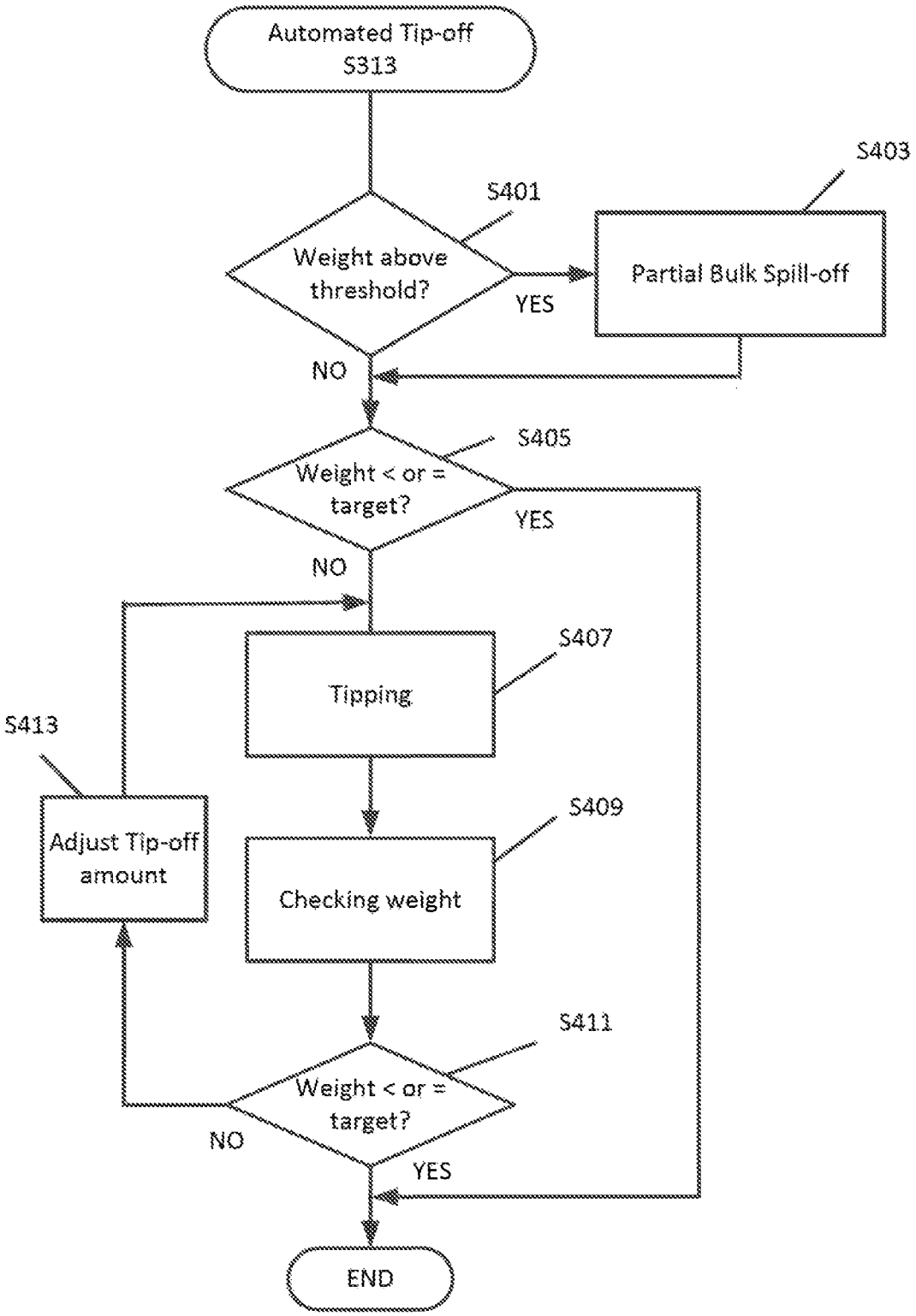
FIG. 4 is a flowchart of steps in automated tip-off in accordance with one or more embodiments of the disclosed subject matter.

FIG. 4 is a flowchart of steps in an automated tip-off process in the case that the Automated Tip-off button 221 is pressed. When the weight of material is above a threshold weight of material (YES in S401), in S403, initially a partial bulk spill may be performed to bring the weight of material in the bucket 118 to below the threshold weight. The threshold weight may be a predetermined weight above a target weight of material. In the case that the weight of material is the target weight (YES in S405), no automated tip-off is needed, and the tip-off process ends. At the point that the weight of material is below the threshold (NO in S401) and greater than the target weight (NO in S405), in S407, a tip-off of the bucket is performed for a predetermined tipping angle and time period. In S409, the weight of the material in the bucket is checked at the end of the time period. When the weight of the material is greater than the target weight (NO in S411), in S413, the tip-off may be adjusted. The tip-off may be adjusted by shaking the bucket harder or softer depending on how close the weight of material is to the target weight. The tip-off may be adjusted by increasing or decreasing the tilting angle of the bucket. The automatic payload tip-off process of steps S407 and S409 may be repeated two or three times. When the weight of the material in the bucket is substantially the target weight (YES in S411), the tip-off process ends. In some embodiments, a second threshold may be set to indicate when the target weight of material has been achieved within a predetermined tolerance level.

Figure 5:
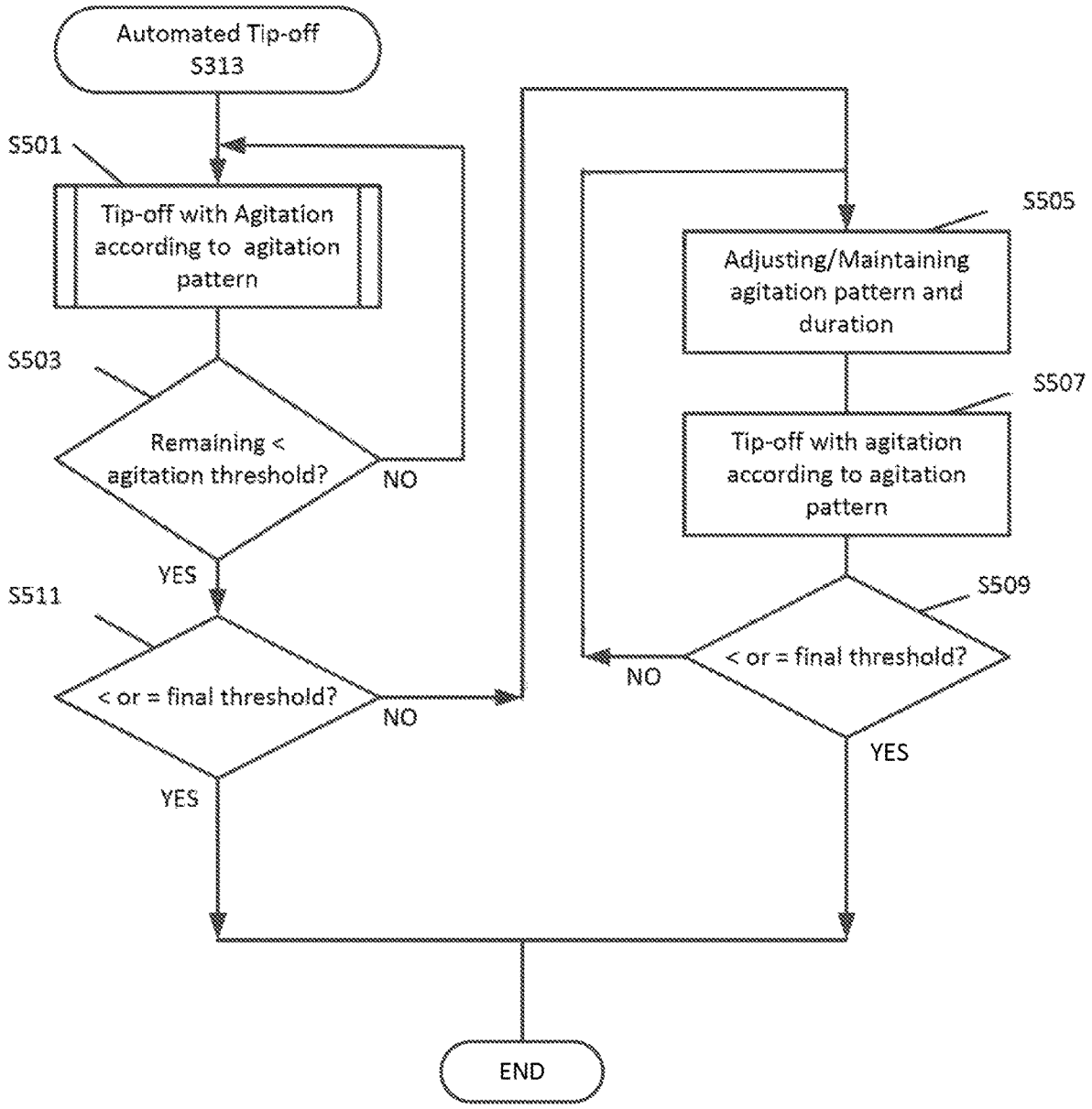
FIG. 5 is a flowchart of steps in automated tip-off including tip-off with agitation in accordance with one or more embodiments of the disclosed subject matter.

FIG. 5 is a flowchart of steps in Automated Tip-off process in a case that the Automated Tip-off with Agitation button 223 is pressed. The automated tip-off with agitation is performed under control of the tip-off controller 132 which controls the hydraulic system 240.

During the tip-off process with agitation, tip and check may be repeated while performing an agitation pattern. The agitation pattern is a signal waveform shape having amplitude and frequency characteristics. The signal waveform shape is used by the tip-off controller 132 to control actuation of the hydraulic system 240 in accordance with the hydraulic system control signal 231. The amplitude of the signal waveform causes the hydraulic system 240 to fluctuate at an amplitude that is proportional to the signal amplitude. The frequency of the signal waveform shape causes the hydraulic system 240 to fluctuate at a rate that is proportional with the frequency. The agitation pattern may be adjusted by changing amplitude, frequency, and/or the waveform shape. For example, the amplitude of the agitation pattern may begin with a nick motion at a certain amplitude, then dialing back the amplitude as the weight of material gets closer to the target weight. The agitation pattern may include one or more flick motions followed by a rapid buzz motion (increased frequency). The agitation pattern may also include a rapid buzz motion followed by one or more flick motions, or may include intermittent flick motions and rapid buzz motions.

The agitation pattern may involve activating the hydraulic system 240, including the electro-hydraulic lift cylinder 124 and/or tilt cylinder 126, at a speed and frequency, preferably in the form of a sine wave, sawtooth, or in the form of a pulsed signal. The electro-hydraulic tilt cylinder 126 may be activated in a pulsing movement that produces agitation of the bucket 118 in a single direction. In one embodiment, the electro-hydraulic tilt cylinder 126 may be activated in a pulsing movement that produces agitation of the bucket 118 rapidly in alternating directions. In one embodiment, agitation of the bucket 118 may be accomplished by pulsing movement applied to lift cylinder 124 for the linkage members 114 connected to the bucket 118. Some especially compacted materials may require an agitation that includes an initial automatic shaking motion in order to break up the material. For most fine sticky materials, agitation may enable a faster spill than a tip-off operation without agitation and with improved accuracy.

Referring to FIG. 5, in S501, the automated tip-off with agitation process is performed in accordance with an initial agitation pattern. In S503, the weight of material is checked to determine whether the remaining weight of the material in the bucket 118 is less than an agitation threshold. When the remaining weight of material is lower than the agitation threshold (YES in S503), in S505, the agitation pattern may be maintained or optionally adjusted. The adjustment of the agitation pattern may include an adjustment in the duration of applying the agitation pattern. The agitation pattern may be adjusted by changing the amplitude and/or frequency of the signal waveform, or by replacing the signal shape with a new signal shape. In the case that the weight of material becomes the target weight when, in S501, the automated tip-off with agitation process is performed in accordance with the initial agitation pattern (YES in S511), no further automated tip-off is needed, and the tip-off process ends.

In S507, the tip-off with agitation is performed using an optional adjusted agitation pattern or a maintained agitation patter, such as the agitation pattern of S505.

In S509, the tip-off controller 132 checks whether the remaining weight of the material in the bucket 118 is less than or equal to a final threshold. The final threshold may be based on a predetermined tolerance level that is substantially smaller than the agitation threshold of S503. When the remaining weight of the material is still greater than the final threshold (NO in S509), the agitation pattern is again optionally adjusted or maintained in S505, and the tip-off with agitation. S507, is again performed using the agitation pattern. The process of adjusting or maintaining the agitation pattern, S505, and the tip-off with agitation, S507, are repeated until the remaining weight of the material is less than the target weight (zero tolerance above the target weight) and within a final threshold (YES in S509).

In order to obtain an accurate measurement of weight, weight may be measured during the tip and check process based on hydraulic pressure in the hydraulic system 240 and by filtering out noise due to agitation. The pressure fluctuations in the electro-hydraulic cylinders 124, 126 and payload in the bucket cause noise in the weight measurement. Historical noise signals during agitation may be analyzed to obtain characteristics of the agitation noise signals. Signal filtering may be performed on the pressure signal 233 during the tip and check process in order to remove the noise due to agitation and obtain a more accurate measurement of weight of material. In addition, noise due to machine resonant frequencies may be analyzed to obtain characteristics of the machine noise. Machine resonant noise may be filtered to obtain a more accurate measurement of weight of material. The weight measurement may be performed periodically during the tip-off of the bucket 118 in the tip and check process.

Figure 6:
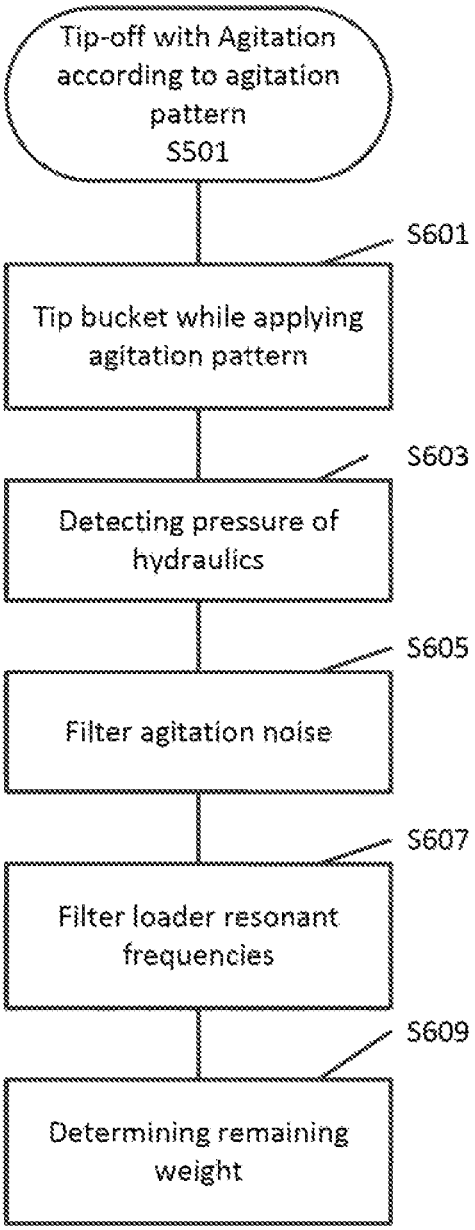
FIG. 6 is a flowchart of details of a step of tip-off with agitation according to an agitation pattern in accordance with one or more embodiments of the disclosed subject matter.

FIG. 6 is a flowchart of details of a step of tip-off with agitation according to an agitation pattern. In S601, the bucket 118 is tipped while applying a predetermined agitation pattern. In S603, the tip-off controller 132 receives the pressure signal 233 of the hydraulic system 240. In S605, the tip-off controller 132 filters out agitation noise. In S607, the tip-off controller 132 filters out wheel loader machine 102 resonant frequencies. In S609, the tip-off controller 132 determines weight of material in the bucket 118 based on the hydraulic system pressure and removal of noise due to agitation noise and wheel loader machine 102 resonant frequencies.

In some embodiments, a different agitation pattern may be chosen depending on the type of material being handled. The type of material may be characterized in accordance with standards for grain sizes, and may include coarse, medium grain, fine grain, and powder. Other more refined categories of grain sizes of material are possible. Thresholds, such as an agitation threshold and a final threshold, may also be different for different types of materials.

Figure 7:
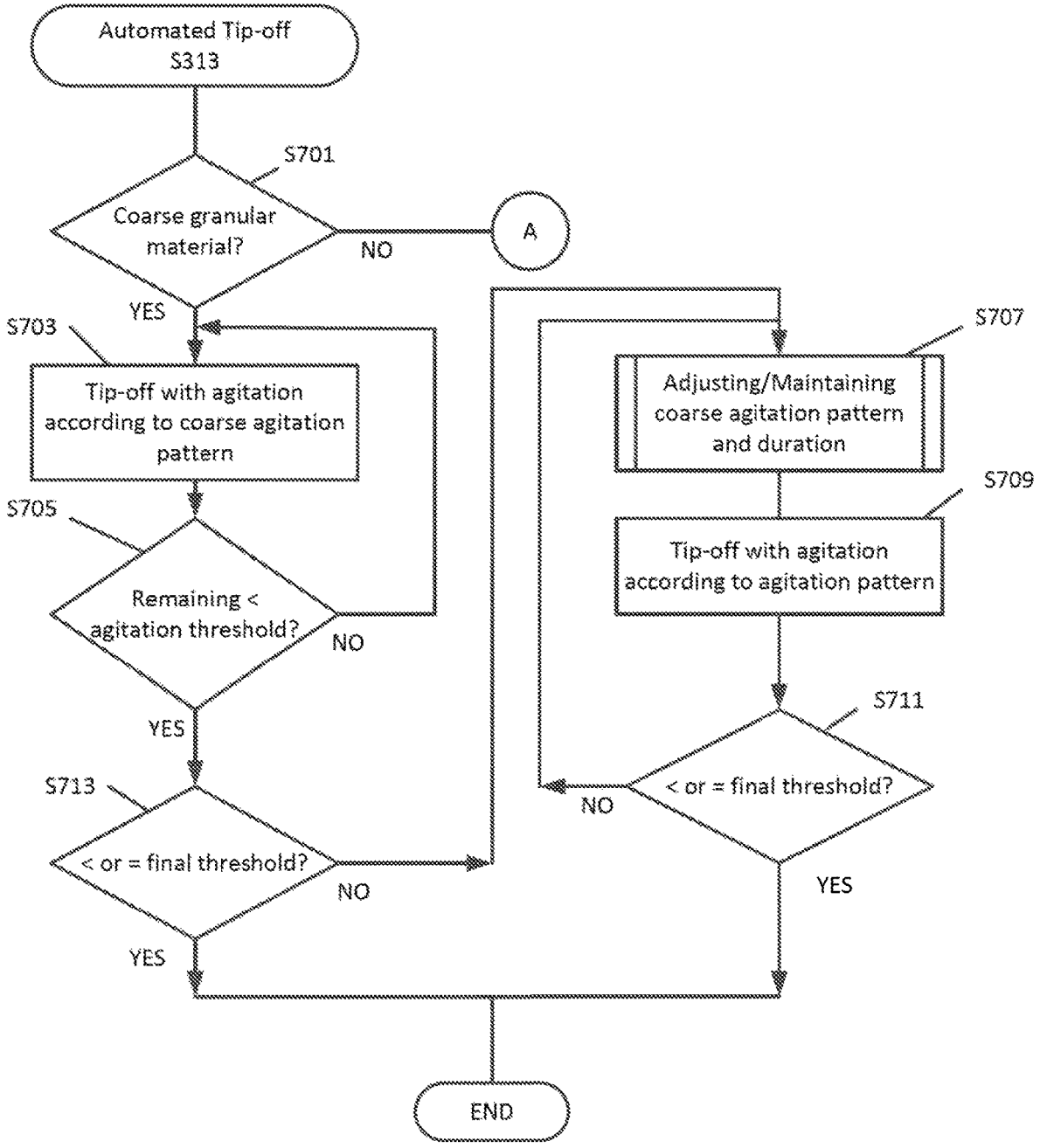
FIG. 7 is a flowchart of steps in automated tip-off including tip-off with agitation in the case of coarse material in accordance with one or more embodiments of the disclosed subject matter.
Figure 8:
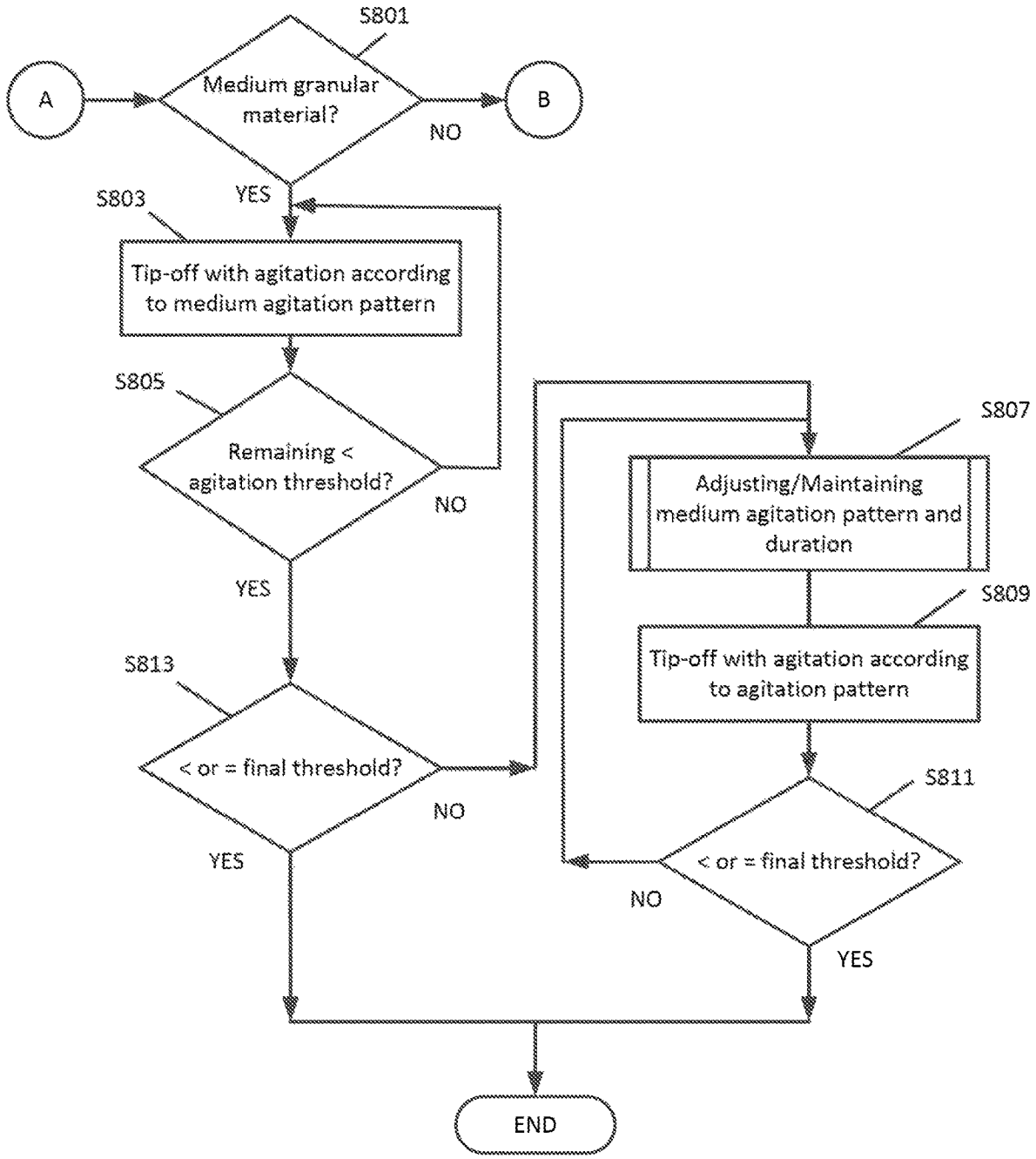
FIG. 8 is a flowchart of steps in automated tip-off including tip-off with agitation in the case of a medium granular material in accordance with one or more embodiments of the disclosed subject matter.
Figure 9:
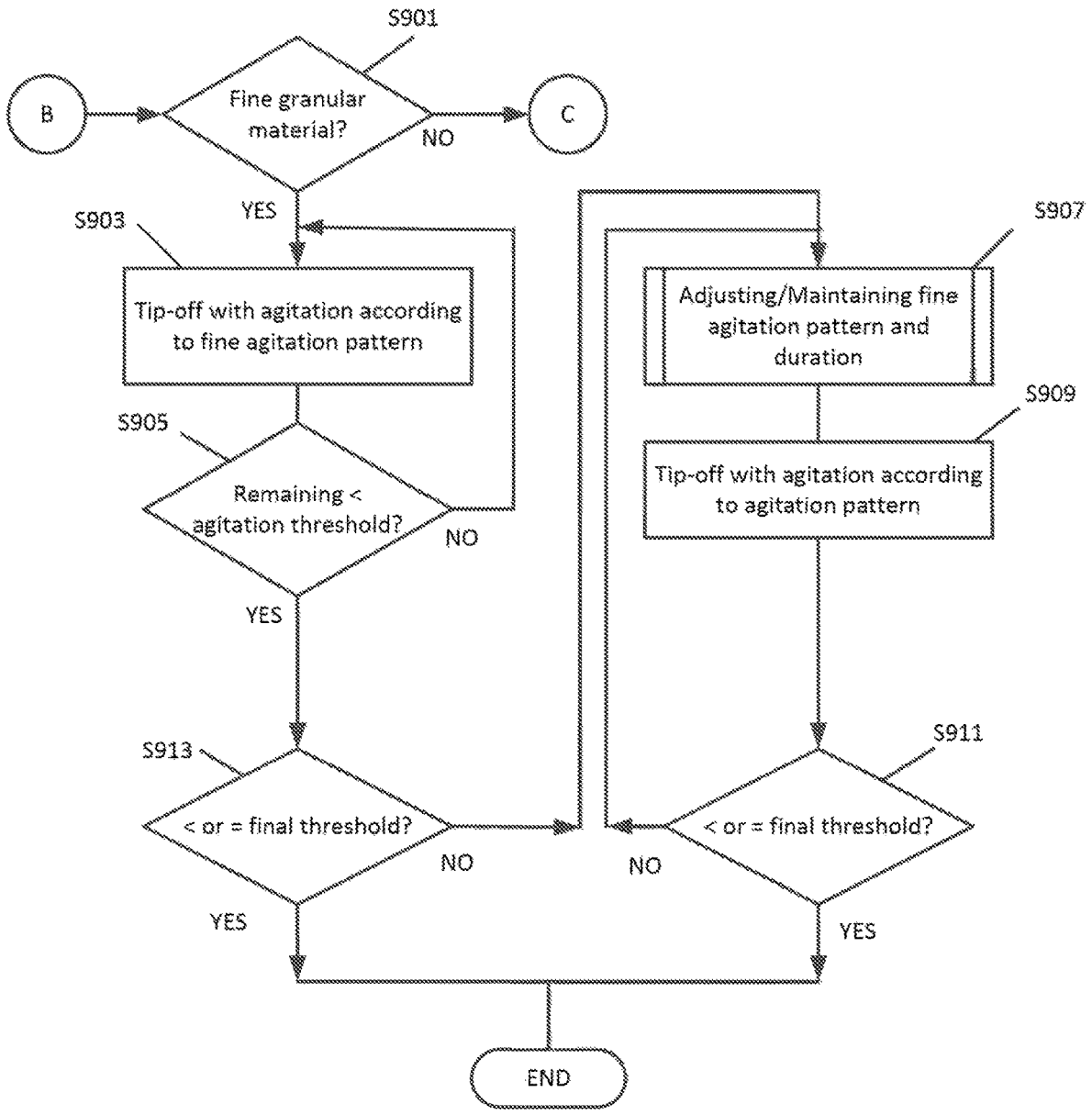
FIG. 9 is a flowchart of steps in automated tip-off including tip-off with agitation in the case of a fine granular material in accordance with one or more embodiments of the disclosed subject matter.
Figure 10:
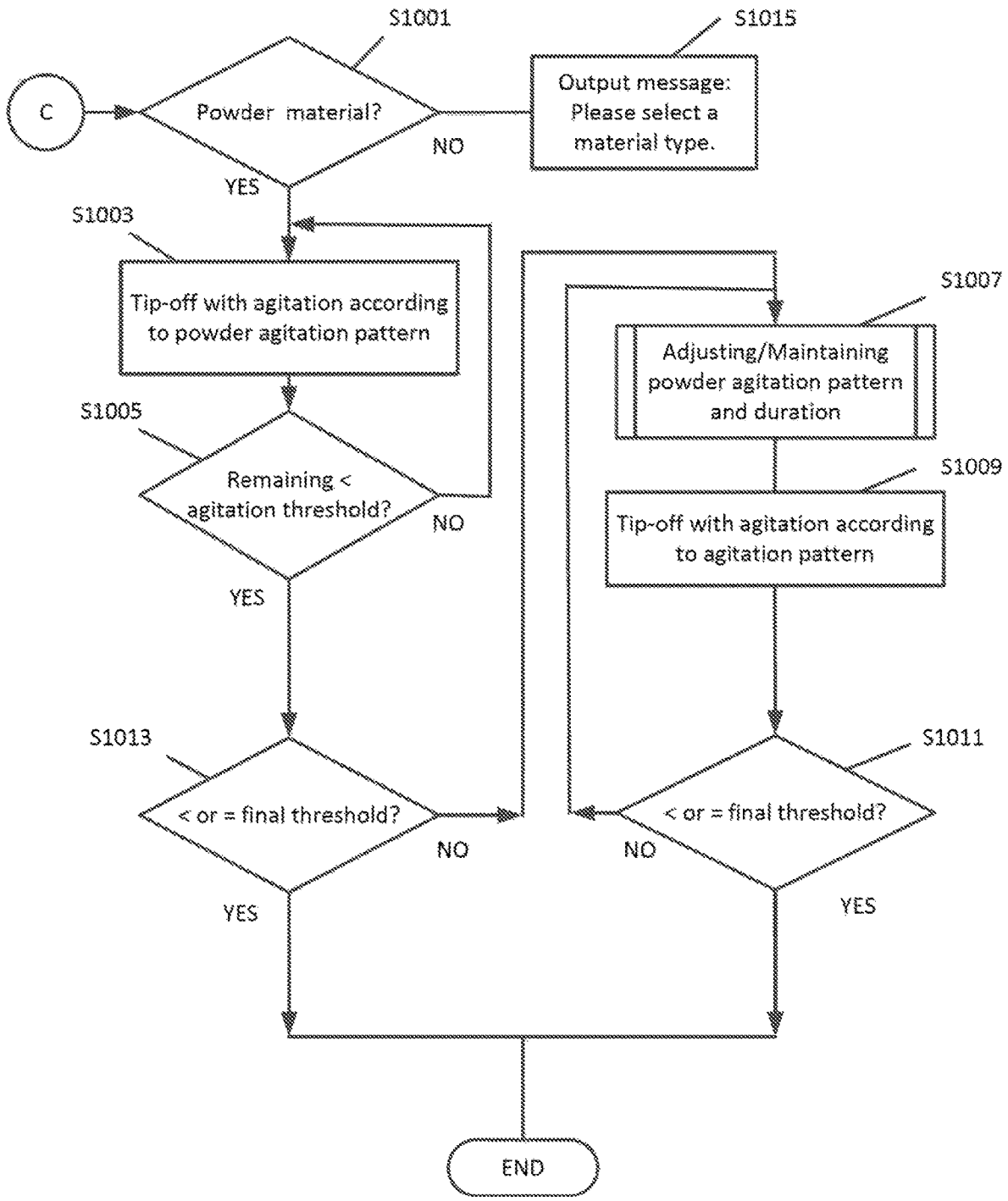
FIG. 10 is a flowchart of steps in automated tip-off including tip-off with agitation in the case of powder material in accordance with one or more embodiments of the disclosed subject matter.

For example, taken together, FIG. 7 through FIG. 8 disclose how the tip-off controller 132 causes agitation in a manner that is appropriate for the size of the material in the bucket 118 of wheel loader machine 102 according to the material type input 205 select by the operator on display device. In FIG. 7, S701, the tip-off controller 132 checks whether coarse granular material was chosen for material type input 205, and if not ("NO"), processing advances through A to FIG. 8. In FIG. 8, the tip-off controller 132 checks whether medium granular material was chosen for the material type input 205, and if not, ("NO"), processing advances through B to FIG. 9. In FIG. 9, the tip-off controller 132 checks whether fine granular material was chosen for the material type input 205, and if not, ("NO"), processing advances through C to FIG. 10. In FIG. 10, the tip-off controller 132 checks whether powder material was chosen for the material type input 205, and if not, ("NO"), a message is provided to the operator to select a material type.

FIG. 7 is a flowchart of a method of bucket agitation in the case of coarse granular material. In S701, the tip-off controller 132 detects whether the type of material that has been input in material-type input 205 is coarse granular material. In S703, when the material is coarse granular material (YES in S701), the tip-off with agitation process is performed in accordance with an initial agitation pattern for coarse granular material. If the material is not coarse granular material (NO in S701), processing moves via A to FIG. 8. The agitation pattern for course granular material may include an aggressive shaking of the bucket 118 at high amplitude followed by a lower amplitude and increased frequency of shaking. In S705, the weight of material is checked to determine whether the remaining weight of the coarse granular material in the bucket 118 is less than an agitation threshold. When the remaining weight of coarse granular material is lower than the agitation threshold (YES in S705), in S707, the agitation pattern may be adjusted or may be maintained. An adjustment of the agitation pattern may include an adjustment in the duration of applying the agitation pattern. The agitation pattern may be adjusted by changing the amplitude and/or frequency of the signal waveform, or by replacing the signal shape with a new signal shape. In the case that the remaining weight of material becomes the target weight (YES in S713), no further automated tip-off is needed, and the tip-off process ends.

In S709, the tip-off with agitation may be performed using an optional adjusted agitation pattern or an agitation pattern maintained from a previous step, such as from S703.

In S711, the tip-off controller 132 checks whether the remaining weight of the coarse granular material in the bucket 118 is less than a final threshold. When the remaining weight of the coarse granular material is still greater than the final threshold (NO in S711), the agitation pattern is again optionally adjusted or maintained in S707, and the tip-off with agitation, S709, is again performed using the agitation pattern. The process of adjusting or maintaining the agitation pattern, S707, and the tip-off with agitation, S709, are repeated until the remaining weight of the coarse granular material is less than the target weight (zero tolerance above the target weight) and within a final threshold (YES in S711).

FIG. 8 is a flowchart of a method of bucket agitation in the case of a medium granular material. In S801, the tip-off controller 132 determines whether the type of material that has been input in material-type input 205 is medium granular material. Medium granular material may require a smaller amount of tilt angle adjustment and smaller agitation amplitudes than that used for coarse granular material. In S803, when the type of material is medium granular material (YES in S801), the tip-off with agitation process is performed in accordance with an initial agitation pattern for medium granular material. The agitation pattern for medium granular material may include an aggressive shaking of the bucket 118 at an average amplitude followed by a lower amplitude and increased frequency of shaking. In S805, the weight of medium granular material is checked to determine whether the remaining weight of the medium granular material in the bucket 118 is less than an agitation threshold. When the remaining weight of medium granular material is lower than the agitation threshold (YES in S805), in S807, the agitation pattern may be maintained or may be adjusted. An adjustment of the agitation pattern may include an adjustment in the duration of applying the agitation pattern. The agitation pattern also may be adjusted by changing the amplitude and/or frequency of the signal waveform, or by replacing the signal shape with a new signal shape. In the case that the remaining weight of material becomes the target weight (YES in S813), no further automated tip-off is needed, and the tip-off process ends.

In S809, the tip-off with agitation may be performed using an optional adjusted agitation pattern or an agitation pattern maintained from a previous step, such as from S803.

In S811, the tip-off controller 132 checks whether the remaining weight of the material in the bucket 118 is less than a final threshold. If the remaining weight of the material is still greater than the final threshold (NO in S811), the agitation pattern is again optionally adjusted or maintained in S807, and the tip-off with agitation, S809, is again performed, possibly using the adjusted agitation pattern. The process of adjusting or maintaining the agitation pattern, S807, and the tip-off with agitation, S809, are repeated until the remaining weight of the material is less than the target weight (zero tolerance above the target weight) and within a final threshold (YES in S811).

FIG. 9 is a flowchart of a method of bucket agitation in the case of a fine granular material. Fine granular material may require smaller adjustments of tilt angle and smaller agitation amplitude than medium granular material. In S901, the tip-off controller 132 determines whether the type of material that has been input in material-type input 205 is fine granular material. In S903, when the type of material is fine granular material (YES in S901), the tip-off with agitation process is performed in accordance with an initial agitation pattern for fine granular material. The agitation pattern for fine granular material may include an aggressive shaking of the bucket 118 at an average amplitude followed by a lower amplitude and increased frequency of shaking. In S905, the weight of fine granular material is checked to determine whether the remaining weight of the fine granular material in the bucket 118 is less than an agitation threshold. When the remaining weight of fine granular material is lower than the agitation threshold (YES in S905), in S907, the agitation pattern may be maintained or may be adjusted. An adjustment of the agitation pattern may include an adjustment in the duration of applying the agitation pattern. The agitation pattern may be adjusted by changing the amplitude and/or frequency of the signal waveform, or by replacing the signal shape with a new signal shape. In the case that the remaining weight of material becomes the target weight (YES in S913), no further automated tip-off is needed, and the tip-off process ends.

In S909, the tip-off with agitation may be performed using an optional adjusted agitation pattern or an agitation pattern maintained from a previous step, such as from S903.

In S911, the tip-off controller 132 checks whether the remaining weight of the fine granular material in the bucket 118 is less than a final threshold. When the remaining weight of the fine granular material is still greater than the final threshold (NO in S911), the agitation pattern is again optionally adjusted or maintained in S907, and the tip-off with agitation, S909, is again performed using the adjusted or maintained agitation pattern. The process of adjusting or maintaining the agitation pattern, S907, and the tip-off with agitation, S909, are repeated until the remaining weight of the material is less than the target weight (zero tolerance above the target weight) and within a final threshold (YES in S911).

FIG. 10 is a flowchart of a method of bucket agitation in the case of powder material. Powder material may be sticky and may not spill evenly and consistently. In S1001, the tip-off controller 132 determines whether the type of material that has been input in material-type input 205 is powder material. In S1003, when the type of material is powder material (YES in S1001), the tip-off with agitation process is performed in accordance with an initial agitation pattern for powder material. The agitation pattern for powder material may include an aggressive shaking of the bucket 118 at an average amplitude followed by a lower amplitude and increased frequency of shaking. In S1005, the weight of powder material is checked to determine whether the remaining weight of the powder material in the bucket 118 is less than an agitation threshold. When the remaining weight of powder material is lower than the agitation threshold (YES in S1005), in S1007, the agitation pattern may be maintained or may be optionally adjusted. An adjustment of the agitation pattern may include an adjustment in the duration of applying the agitation pattern. The agitation pattern may be adjusted by changing the amplitude and/or frequency of the signal waveform, or by replacing the signal shape with a new signal shape. In the case that the remaining weight of material becomes the target weight (YES in S1013), no further automated tip-off is needed, and the tip-off process ends.

In S1009, the tip-off with agitation may be performed using an optional adjusted agitation pattern or an agitation pattern maintained from a previous step, such as from S1003.

Figure 11:
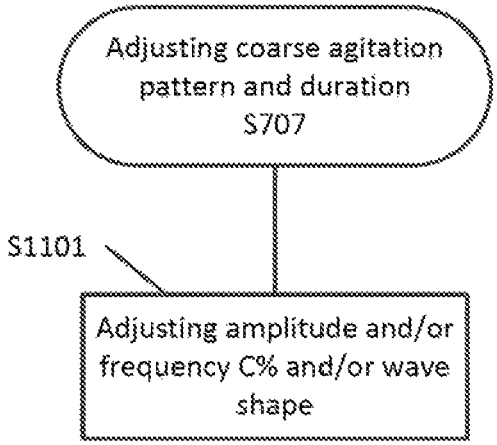
FIG. 11 is a flowchart of a step of adjusting coarse agitation pattern and duration in accordance with one or more embodiments of the disclosed subject matter.

In S1011, the tip-off controller 132 checks whether the remaining weight of the powder material in the bucket 118 is less than a final threshold. When the remaining weight of the powder material is still greater than the final threshold (NO in S1011), the agitation pattern is again optionally adjusted or maintained in S1007, and the tip-off with agitation, S1009, is again performed using the adjusted or maintained agitation pattern. The process of optionally adjusting or maintaining the agitation pattern, S1007, and the tip-off with agitation. S1009, are repeated until the remaining weight of the powder material is less than the target weight (zero tolerance above the target weight) and within a final threshold (YES in S1011), FIG. 11 is a flowchart for a case in which the coarse agitation pattern and duration are adjusted in the method of bucket agitation in S707. As mentioned above, the agitation pattern may be adjusted by adjusting amplitude, frequency, or wave shape. Also, the duration of the agitation pattern may be adjusted. As an example, in the case of coarse granular material, in S1101, the agitation pattern may be adjusted by changing the amplitude and/or frequency by a percentage, C %, and/or by changing the wave shape. For example, the change of wave shape may include a change from high frequency low amplitude buzz motions and to lower frequency higher amplitude flick motions, or other combinations thereof.

Figure 12:
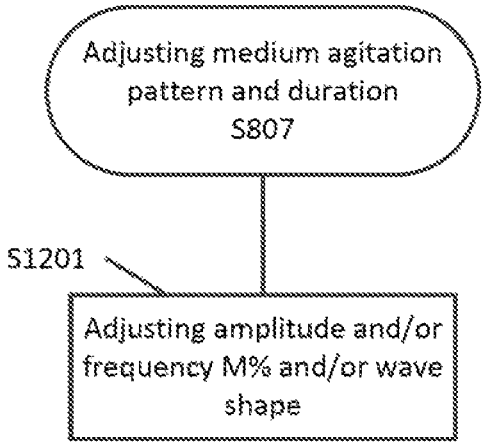
FIG. 12 is a flowchart of a step of adjusting medium agitation pattern and duration in accordance with one or more embodiments of the disclosed subject matter.

FIG. 12 is a flowchart for a case in which the medium agitation pattern and duration are adjusted in the method of bucket agitation in S807. In the case of a medium granular material, as an example, in S1201, the agitation pattern may be adjusted by changing the amplitude and/or frequency by a percentage, M %, that is different from the percentage C %, and/or by changing the wave shape. For example, the change of wave shape may include a change from high frequency low amplitude buzz motions and to lower frequency higher amplitude flick motions, or other combinations thereof.

Figure 13:
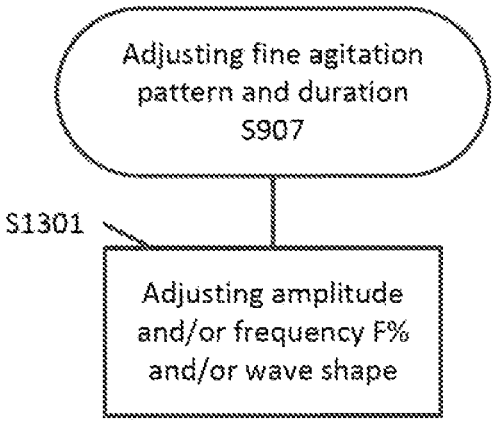
FIG. 13 is a flowchart of a step of adjusting fine agitation pattern and duration in accordance with one or more embodiments of the disclosed subject matter.

FIG. 13 is a flowchart for a case in which the fine agitation pattern and duration are adjusted in the method of bucket agitation in S907. In the case of a fine granular material, as an example, in S1301, the agitation pattern may be adjusted by changing the amplitude and/or frequency by a percentage, F %, that is different from the percentage M % and the percentage C %, and/or by changing the wave shape. For example, the change of wave shape may include a change from high frequency low amplitude buzz motions and to lower frequency higher amplitude flick motions, or other combinations thereof.

Figure 14:
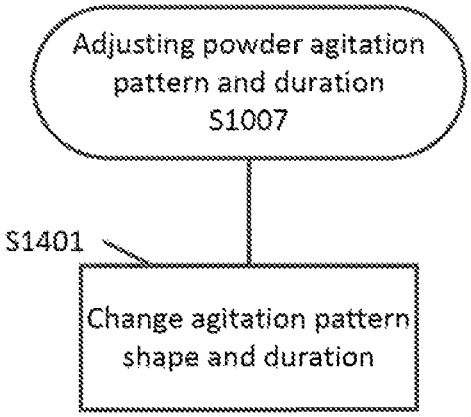
FIG. 14 is a flowchart of a step of adjusting powder agitation pattern and duration in accordance with one or more embodiments of the disclosed subject matter.

FIG. 14 is a flowchart for a case in which the powder agitation pattern and duration are adjusted in the method of bucket agitation in S1007. In the case of a powder material, as an example, in S1401, the agitation pattern may be adjusted by changing the pattern wave shape and duration. For example, the change of wave shape may include a change from high frequency low amplitude buzz motions and to lower frequency higher amplitude flick motions, or other combinations thereof.

In order to continue to improve the accuracy of tip-off amount for various types of materials, machine learning may be used to model the tip-off with agitation process from one or more perspectives. In one perspective, machine learning may be used to model an amount of material spilled during dumping by the bucket based on features of the tip-off process including the agitation pattern. In one perspective, machine learning may be used to model adjustments to the agitation pattern, where the agitation pattern is a sequence.

The machine learning may be performed using a general purpose computer, preferably equipped with circuitry such as a graphics processing unit (GPU) or other special purpose processor for carrying out mathematical functions required by the machine learning. Alternatively, the machine learning may be performed in a cloud service that provides support for machine learning algorithms. The machine learning may use a statistical model, e.g., Bayesian probability for ease of training. The machine learning may use a simple single layer neural network, for adaptive learning (iterative, online learning). The machine learning may use a temporal sequence model, e.g., recurrent neural network, to learn a sequence of tip-check-with agitation steps for a particular type of material.

Figure 15:
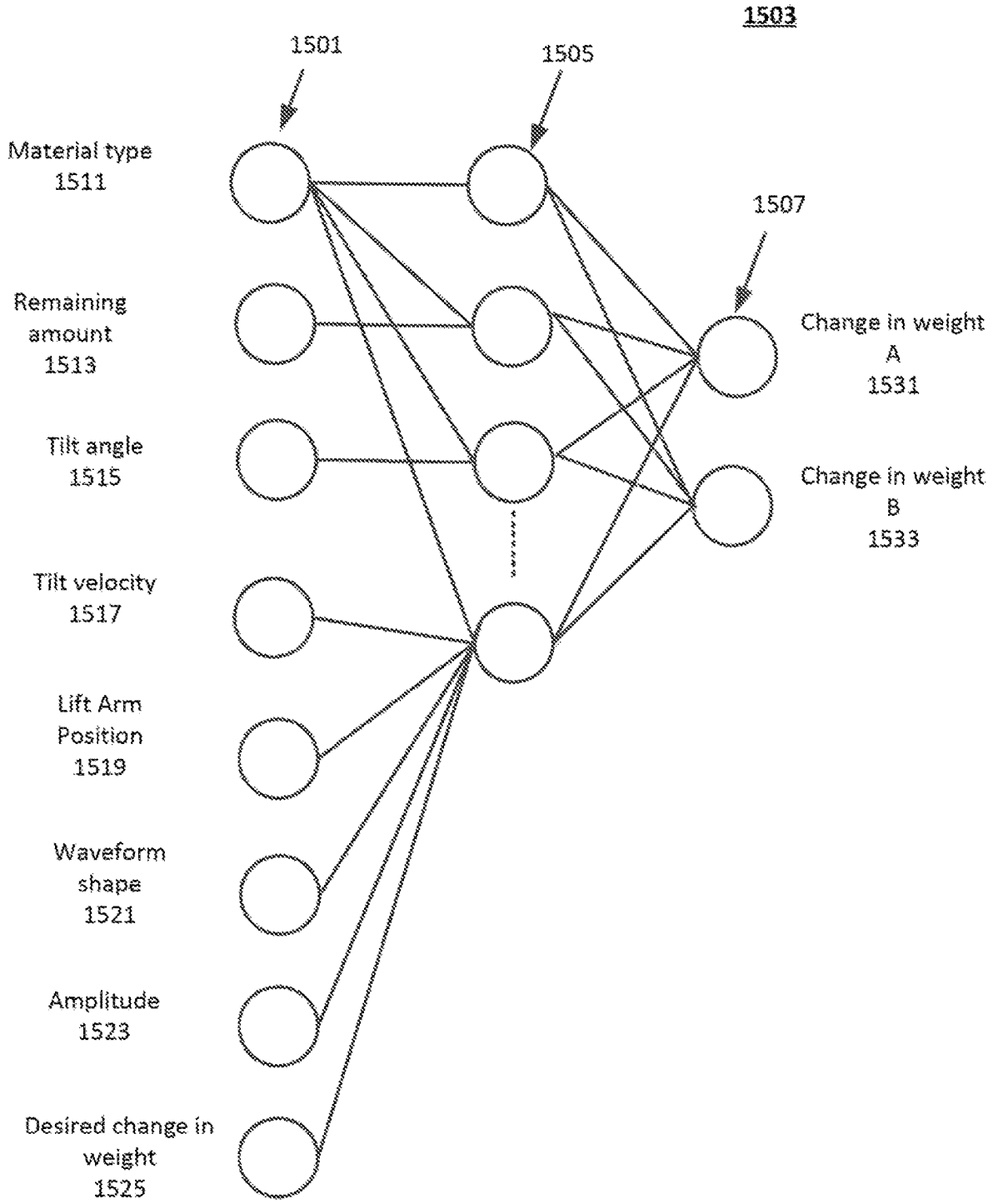
FIG. 15 is a diagram of an architecture of a neural network for adaptively determining change in material weight based on an agitation pattern in accordance with one or more embodiments of the disclosed subject matter.

FIG. 15 is a diagram of an architecture of a neural network 1503 for adaptively determining a change in material weight based on an agitation pattern. In an embodiment, the tip-off, agitating and checking to dump a certain amount of material may be improved using machine learning. A machine learning model may be used for improving the accuracy of a material dumping amount (change in the weight of the material as a result of a dump) for an agitation pattern including making amplitude adjustments, choice of wave pattern, certain type of material, bucket tilt angle, bucket tilt velocity, and lift arm elevation. The bucket tilt angle may be the full tilt angle for a tip motion of the bucket in a single tip-off action. The bucket tilt velocity may be the velocity of tilt to the tilt angle. The lift arm elevation may be the length that the lift cylinder 124 is extended during a tip motion.

Referring to FIG. 15, a non-limiting exemplary neural network 1503 may be configured with a neural network input 1501 that can include material type 1511, remaining amount of material in the bucket 1513, tilt angle for a tip motion 1515, tilt velocity for a tip motion 1517, lift arm position 1519, agitation pattern waveform shape 1521, pattern amplitude 1523, and desired change in weight 1525. The output of the neural network 1503 may be configured with a neural network output 1507 of change of weight of the material in a single tip motion. The neural network output 1507 is not limited to the layer of nodes shown in FIG. 15, and may take any of several different forms. For example, a change in weight may be represented as several nodes, where each node is a range of weights, e.g., range A 1531, range B 1533, or may be several nodes to represent a binary value for an amount or percentage of change in weight. The neural network 1503 may be a single layer neural network, or may include optional at least one hidden layer 1505. The neural network 1503 may be adaptive and can learn a change in material weight for agitation patterns for different types of materials. In order to be adaptive (i.e., trained online), the neural network 1503 may be trained using a stochastic gradient descent algorithm.

Figure 16:
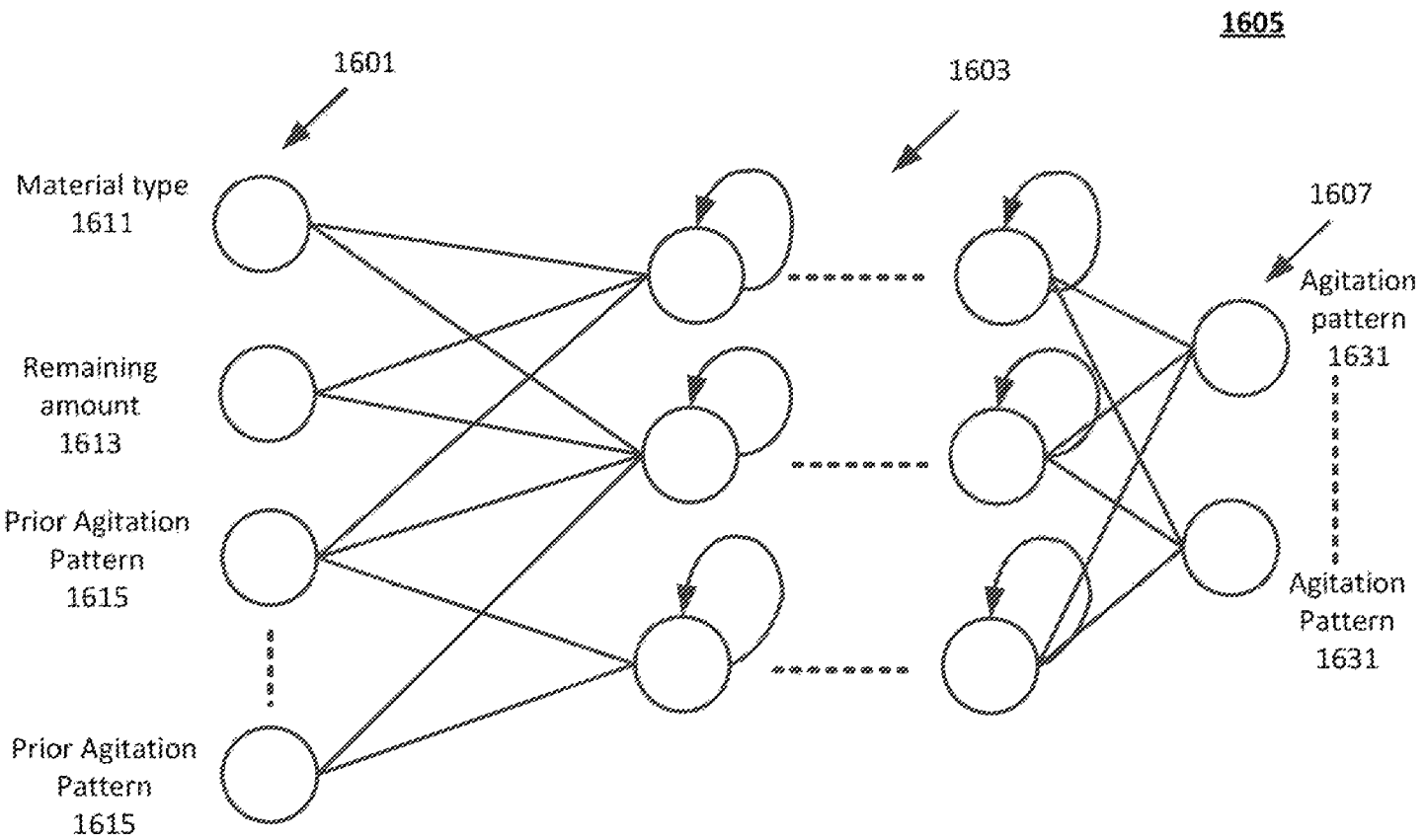
FIG. 16 is a diagram of an architecture of a recurrent neural network for determining an agitation pattern as a sequence in accordance with one or more embodiments of the disclosed subject matter.

FIG. 16 is a diagram of an architecture of a recurrent neural network (RNN) 1605 for determining an agitation pattern as a sequence in accordance with an embodiment of the present disclosure. In one or more non-limiting embodiments, the agitation pattern may be in the form of a sequence, such as a time series, in which an adjustment made to the agitation pattern may be learned as a revised sequence. The sequential agitation pattern may be a wave shape that varies over time and is dependent on such features as the type of material and the amount of material remaining in the bucket.

In one or more embodiments, a recurrent neural network 1605 may be trained for to learn a relationship between a type of material, an amount of material remaining in the bucket, and a prior agitation pattern sequence as an input and an adjusted agitation pattern sequence as an output.

A recurrent neural network 1605 may be configured to learn time series data, and may be configured using Long Short-Term Memory (LSTM) units. A RNN 1605 using LSTM units can be trained in a supervised fashion, on a set of training sequences, using an optimization algorithm, like gradient descent, combined with backpropagation through time to compute the gradients needed during the optimization process, in order to change each weight of the LSTM network in proportion to the derivative of the error (at the output layer of the LSTM network) with respect to corresponding weight.

Referring to FIG. 16, an exemplary recurrent neural network 1605 may be configured with a RNN input 1601 of material type 1611, remaining amount 1613, and prior agitation pattern sequence 1615. The RNN output 1607 of the recurrent neural network 1605 may be configured with an output of an adjusted agitation pattern sequence 1631. At least one hidden layer 1603 having feedback connections are included between the RNN input 1601 and RNN output 1607. The prior agitation pattern sequence may be input in sections of a certain window size, or may be input as one time step, where each time step is input one at a time in sequence. The adjusted agitation pattern sequence may be output in synchronization with the input of the prior agitation pattern sequence.

In alternative embodiments, a RNN input to a recurrent neural network 1605 may consist of a sequence of remaining amount of material of a material type and the RNN output 1607 may be an agitation pattern that corresponds to the remaining amount of material.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A construction vehicle comprising:

an electro-hydraulic system;

a bucket operated by the electro-hydraulic system and configured to hold a payload;

an automated tip-off system; and a controller configured to:

identify that a tip-off process is to be performed, wherein the tip-off process causes the electro-hydraulic system to operate the bucket to spill a portion of the payload, and cause, based on identifying that the tip-off process is to be performed, the electro-hydraulic system to agitate the bucket according to an agitation pattern.

2. The construction vehicle of claim 1, wherein the controller includes a memory to store a plurality of agitation patterns, and wherein the plurality of agitation patterns are wave patterns.

3. The construction vehicle of claim 2, wherein the controller is configured to adjust at least one agitation pattern, of the plurality of agitation patterns, by changing a waveform shape of the at least one agitation pattern, and wherein the waveform shape is one or more of a sine wave, a saw tooth shape, or a square wave.

4. The construction vehicle of claim 2, wherein the controller is configured to adjust at least one agitation pattern, of the plurality of agitation patterns, by changing one or more of an amplitude or a frequency of a waveform shape of the at least one agitation pattern.

5. The construction vehicle of claim 2, wherein the controller is configured to adjust at least one agitation pattern, of the plurality of agitation patterns, by replacing the at least one agitation pattern with a new agitation pattern.

6. The construction vehicle of claim 2, wherein the controller is configured to adjust at least one agitation pattern, of the plurality of agitation patterns, by changing a duration that the electro-hydraulic system causes the bucket to agitate according to the at least one agitation pattern.

7. The construction vehicle of claim 1, further comprising an input-output device configured to receive input of control parameters and to output bucket status information, wherein the input-output device includes an input for identifying one or more types of granular or powder material, and wherein the controller includes a memory to store a plurality of agitation patterns that correspond to the one or more types of granular or powder material.

8. The construction vehicle of claim 1, wherein the agitation pattern causes, via the electro-hydraulic system, a flick of the bucket followed by a buzz motion of the bucket.

9. The construction vehicle of claim 1, wherein the controller is configured to determine a weight of the payload in the bucket, via periodic weighing of the payload, and based on at least one hydraulic pressure of the electro-hydraulic system, removal of noise that is caused by agitation of the bucket according to the agitation pattern, or at least one resonant frequency of the construction vehicle.

10. The construction vehicle of claim 1, wherein the controller is configured to cause the electro-hydraulic system to agitate the bucket, according to the agitation pattern, during the tip-off process.

11. The construction vehicle of claim 1, wherein the controller is configured to agitate the bucket, according to the agitation pattern, during operation of the bucket to spill the portion of the payload.

12. The construction vehicle of claim 1, wherein the controller is configured to agitate the bucket, according to the agitation pattern, throughout operation of the bucket to spill the portion of the payload.

13. The construction vehicle of claim 1, wherein the controller is further configured to cause, based on identifying that the tip-off process is to be performed, the electro-hydraulic system to operate the bucket to spill the portion of the payload.

14. A control system comprising:

an electro-hydraulic system;

a bucket operated by the electro-hydraulic system and configured to hold a payload; and a controller configured to:

identify, based on information from one or more sensors associated with the bucket, that a tip-off process is to be performed, wherein the tip-off process causes the electro-hydraulic system to operate the bucket to spill a portion of the payload; and cause, based on identifying that the tip-off process is to be performed, the electro-hydraulic system to agitate the bucket according to an agitation pattern.

15. The control system of claim 14, wherein the controller is further configured to:

determine, based on the information from the one or more sensors, a weight of the payload, wherein the portion of the payload that is spilled from the bucket during the tip-off process is based, at least in part, on the weight of the payload.

16. The control system of claim 14, wherein the controller is further configured to:

store, in a memory of the controller, a plurality of agitation patterns, wherein the agitation pattern is a first agitation pattern of the plurality of agitation patterns, and wherein the plurality of agitation patterns are wave patterns.

17. The control system of claim 14, wherein the controller is further configured to:

identify, via the controller, one or more types of granular or powder material of the payload; and identify the agitation pattern, from a plurality of agitation patterns stored in a memory associated with the controller, based on identifying the one or more types of granular or powder material of the payload.

18. A method of controlling an electro-hydraulic system to operate a bucket of a machine that is configured to hold a payload, the method comprising:

identifying, via a controller, that a tip-off process is to be performed, wherein the tip-off process causes the electro-hydraulic system to operate the bucket to spill a portion of the payload; and causing, via the controller and based on identifying that the tip-off process is to be performed, the electro-hydraulic system to agitate the bucket according to an agitation pattern.

19. The method of claim 18, wherein identifying that the tip-off process is to be performed is based, at least in part, on information from one or more sensors associated with the bucket, the method further comprising:

determining, based on the information from the one or more sensors, a weight of the payload, wherein the portion of the payload that is spilled from the bucket during the tip-off process is based, at least in part, on the weight of the payload.

20. The method of claim 18, further comprising:

storing, in a memory of the controller, a plurality of agitation patterns, wherein the agitation pattern is a first agitation pattern of the plurality of agitation patterns, and wherein the plurality of agitation patterns are wave patterns;

identifying, via the controller, one or more types of granular or powder material of the payload; and identifying the first agitation pattern, from the plurality of agitation patterns stored in the memory of the controller, based on identifying the one or more types of granular or powder material of the payload.

* * * * *